United States Patent [19]

Fee

[11] 4,442,973

[45] Apr. 17, 1984

[54] RAIL FASTENING ASSEMBLIES

[75] Inventor: Graham M. Fee, Geneva, Ohio

[73] Assignee: True Temper Railway Appliances, Inc., Chicago, Ill.

[21] Appl. No.: 228,804

[22] Filed: Jan. 27, 1981

Related U.S. Application Data

[63] Continuation of Ser. No. 933,630, Aug. 14, 1978, abandoned.

[51] Int. Cl.[3] ..... E01B 9/30

[52] U.S. Cl. ..... 238/349; 238/338

[58] Field of Search ..... 238/310, 315, 338, 341, 238/343, 349

[56] References Cited

U.S. PATENT DOCUMENTS

| | | | |
|---|---|---|---|
| 3,018,967 | 1/1962 | Khalil | 238/349 |
| 3,887,128 | 6/1975 | Ruble | 238/349 |

FOREIGN PATENT DOCUMENTS

| | | | |
|---|---|---|---|
| 2741238 | 4/1978 | Fed. Rep. of Germany | 238/349 |
| 1044884 | 10/1966 | United Kingdom | 238/349 |
| 1154497 | 6/1969 | United Kingdom | 238/349 |
| 1305871 | 2/1973 | United Kingdom | 238/349 |
| 1496390 | 12/1977 | United Kingdom | 238/349 |
| 1519875 | 8/1978 | United Kingdom | 238/349 |

*Primary Examiner*—Randolph Reese

*Attorney, Agent, or Firm*—John K. Williamson; John L. LaPierre; James C. Valentine

[57] ABSTRACT

A rotatable or twist-on rail fastening assembly for securing a railway rail to an anchoring support therefor is comprised of a generally S-shaped torsional spring rail clip and a post-type mounting or chair adapted to cooperate therewith. The rail clip includes a central leg, a tie anchor portion and a rail bearing portion comprising a pair of loops spaced on opposite sides and extending from opposite ends thereof, each of the loops including an arcuate and a terminal leg. The chair is adapted to have the one loop of the S-shaped clip rotated around the post.

5 Claims, 12 Drawing Figures

RAIL FASTENING ASSEMBLIES

This is a continuation, of application Ser. No 933,630, filed Aug. 14, 1978 now abandoned.

The present invention relates, generally, to assemblies for securing a rail to an anchoring support or crosstie therefor. More specifically, the present invention relates to a simplified twist-on rail fastening assembly including a torsional spring rail clip having a generally S-shaped geometrical configuration, said clip being substantially S-shaped and adapted to have a loop portion thereof rotated or twisted into engagement with a portion of a post-type chair, said post portion restraining a rail bearing portion of the clip in proximate engagement with the base flange of a railway rail.

Reference is made to copending application entitled "Improvements in Rail Fastening Assemblies", filed on Aug. 2, 1978, Ser. No. 930,232, now abandoned, pertaining to a drive-on fastener.

Various and diverse types of rail fastening assemblies are well known in the prior art. For example, it has become commonplace to secure sections of railway rail to a support (i.e., a sleeper or tie) by means of a generally planar fixture secured to the support by a fastener, with a portion, or extension, of the fixture in contact with the base of the rail. Such clips are commonly termed compression type rail spring clips. Note, for example, U.S. Pat. Nos. 3,206,123; 3,309,023; 3,362,639; 3,378,200; 3,436,018 and 3,477,642, which are exemplary of this class of devices.

Within the recent past, rail clips have been proposed for anchoring rail sections which eliminate the need for a fastener passing directly through the clip or rail-contacting structure itself by employing separate clip and fastener structures. One such class of rail anchoring devices has become known in the art as "Pandrol" clips, which are multi-element clips having a plurality of linear sections joined by convolute sections, whereby the overall profile of the clip may best be described as toric in nature. Along these lines see, for example, U.S. Pat. Nos. 3,004,716; 3,297,253; 3,427,700; 3,658,246, 3,700,167 and 4,073,435. Numerous other references disclose these or similar railway clips having toric profiles, and having the aforementioned convolute connecting segments between the several linear elements of the clip. Yet another type of rail clip which might be catergorized as conceptually similar to the "Pandrol" clips is disclosed in U.S. Pat. No. 4,067,495.

Another variety is that marketed by the Tempered Railway Equipment Co. of Sheffield, England, under the name "Springlock". This assembly employes a leaf spring type clip which is restrained in a somewhat horizontal position by an anchoring member, with one end of the clip in engagement with the base flange of the rail, the other end supported by a heel block.

Other efforts directed toward facilitating the anchoring of rail sections to a support include rotatable camming rail clips, such as those disclosed in U.S. Pat. No. 3,018,967 which function in a manner similar to a conventional window latch, being comprised of a base plate having the camming element positioned thereon. When installed proximate the base flange of a rail, the clip may be rotated into engagement therewith.

With respect to rail fastening assemblies of the prior art employing separable rail clips and chairs therefor (the term "chair" is used herein to denote tie securing means adapted to engage the rail clip in secure engagement therewith), the same offer various drawbacks. Although generally effective in terms of their ability to secure the rail to the tie or sleeper, frequently the fabrication and installation thereof are cumbersome and complex. Typically, toric profiles resultant from convolute intermediate sections as related in certain prior art rail clips require considerable forming operations in order to obtain a serviceable device. Likewise, chairs employed in conjunction with this type of clip also require special casting.

In an effort to overcome these manufacturing problems, U.S. Pat. No. 4,067,495 discloses a spring clip having a pair of distal mounting legs projecting in the same direction and adapted to be seated on opposite sides of the chair and having a cross-over loop, the clip being of generally B-shaped configuration. The clip, while relatively simple to manufacture, requires precise dimensioning and curving of the loop and captured ends.

It is sometimes advantageous to provide a shim or electrical insulator pad between the rail base flange and portion of the clip bearing thereon; as described in U.S. Pat. Nos. 3,460,756 and 3,463,394. In said patented structures, the pads are provided with lateral projections or ears extending from the anchoring element and engaging the outer surfaces of the chair.

In accordance with the deficiences of prior art rail fastening assemblies, it is a principal object of the present invention to provide a rotatable or twist-on rail fastening assembly which is of simplified construction, but which operates efficiently under all conditions of use.

Another object of the present invention is to provide a versatile, rotatable or twist-on rail fastening assembly which may be manufactured and installed in a materially easier manner than prior art rail clips.

Still another object of the present invention is to provide a rotatable or twist-on rail fastening assembly which eliminates the need to employ any threaded parts for mounting the same.

Yet another object of the present invention is to provide a rotatable or twist-on rail fastening assembly including a chair which establishes an anchoring-effective torsional force on the generally S-shaped torsional spring rail clip, whereby anchoring efficiency of the assembly is enhanced.

A further object of the present invention is to provide a rail fastening assembly for use in conjunction with concrete ties, where forces exerted on the tie by the assembly are uniformly distributed to improve service life of the tie.

It has now been determined, in accordance with the present invention, that the foregoing objects may be realized by providing a rotatable or twist-on rail fastening assembly for securing a railway rail to a tie or sleeper therefor, which assembly comprises a generally S-shaped torsional spring rail clip and a cooperating post-type chair adapted to have the clip rotated or twisted into secure engagement therewith. The rail clip includes a central leg, and a tie anchor portion and a rail bearing portion comprising a pair of loops on opposite sides and extending from opposite ends thereof, each of the loops having an arcuate and a terminal leg. The assembly includes means for establishing a torsional force on the central leg by appropriately tensioning the terminal legs of the loop members.

Yet other objects and advantages of the present invention will become apparent to the skilled artisan upon examination of the following detailed description thereof, taken in conjunction with the figures of drawings, wherein.

Figure 1:
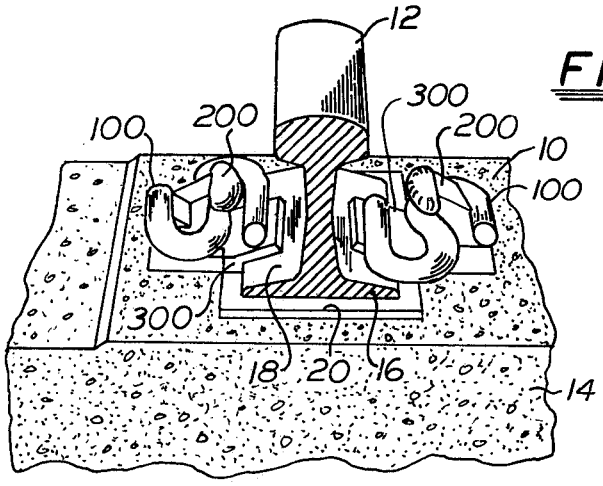
FIG. 1 is an isometric view of a pair of rail fastening assemblies in accordance with the present invention, shown anchoring a railway rail to a concrete support.

The present invention relates to rotatable or twist-on rail fastening assemblies for securing a railway rail to a tie or sleeper. Rail fastening assemblies are designed to effectively force-couple the railway rail to the tie or sleeper in order to anchor the rail for effective use. In terms of the present invention, this is achieved by embedding the shank of the chair member of the boltless fastener type within the concrete cross tie, securing the rail clip to the chair head disposed above the tie, and securing the clip to the base flange of the rail. Consequently, the rail is force-coupled through the rail clip/-chair/tie.

By virtue of this cooperative assembly, complex forces come into play under dynamic conditions in addition to static forces existing between the components, including forces due to expansion and contraction of the rails. The rail fastening assembly must firmly restrain the base of the rail under static conditions and must also operate efficiently under those dynamic conditions which occur during passage of a train along the railway tracks. It is important that the rail fastening assembly maintains positive restraining force on the railway rails under all conditions of use, regardless of longitudinal or wave motion of the railway tracks.

Referring to the figures, in all of which like parts are designated by like reference characters, FIGS. 1–4 show a rail fastening assembly, designated generally as 10, anchoring a section of railway rail 12 to a concrete tie 14. The rail 12, as is conventional, includes a base 16 having laterally projecting flanges 18. A tie pad 20 is interposed between the tie 14 and base 16 of the rail.

The assembly 10 is comprised of a generally S-shaped torsional rail clip, designated generally as 100; a chair, designated generally as 200, adapted to have the clip rotated or twisted thereon; and a shimming pad designated as 300 interposed between the base flange 18 and clip 100. For convenience, that side of the chair 200 facing rail 12 (as viewed in FIG. 2) will be termed the "inner side", while the opposite side will be termed the "outer side". Similarly, that end of the chair 200 to the right as viewed in FIG. 4 will be termed the "front end", while the opposite end will be termed the "back end".

Figure 9:
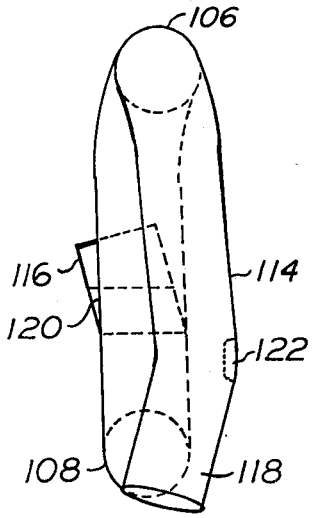
FIG. 9 is a side elevational view of the rail clip of FIG. 8.
Figure 11:
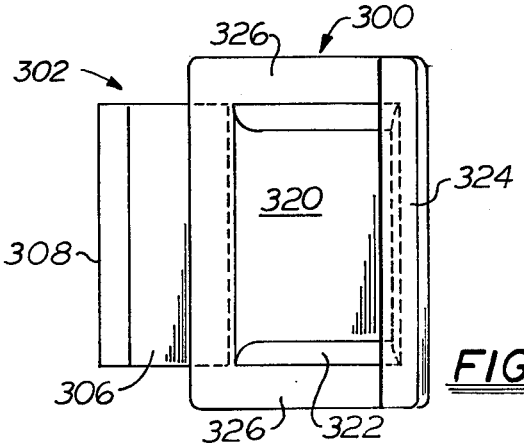
FIG. 11 is a top plan view of an insulator pad employed in the rail fastening assembly of the present invention.
Figure 12:
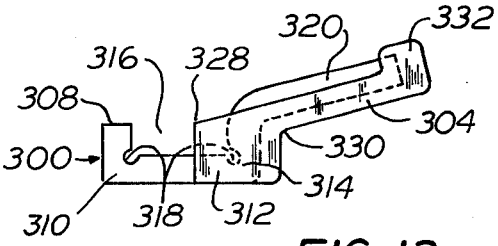
FIG. 12 is a side elevational view of the insulator pad shown in FIG. 11.

The rail clip 100 is a torsional spring rail clip having a generally S-shaped geometrical configuration. The simplicity inherent in this design facilitates both the fabrication of the clip as well as application thereof, as described more fully hereinbelow. The clip 100 is comprised of a central leg 102 and a pair of loops 104 and 106 on opposite sides and extending from opposite ends thereof. Loop 104 comprises the tie anchor portion of clip 100, while loop 106 comprises the rail bearing portion thereof, as viewed in FIG. 2. Loop 104 includes an arcuate leg 108 and a terminal leg 110. Similarly, loop 106 includes an arcuate leg 112 and a terminal leg 114. Each of the terminal legs 110 and 114 has a free distal end, 116 and 118, respectively. Preferably, the legs have upwardly divergent ends, as shown in FIG. 9. It is preferred that the tie anchor terminal leg 110 has a recess or slot 120 formed therein, which recess is dimensioned to mate with a protuberant or detent member formed on the post portion of chair 200 in order that the clip may be latched thereon. It is also preferable to provide a flat 122 at the juncture of the rail anchor terminal leg and its upwardly divergent end, as best viewed in FIG. 9, to facilitate a smoother rotation of the clip during installation.

Figure 8:
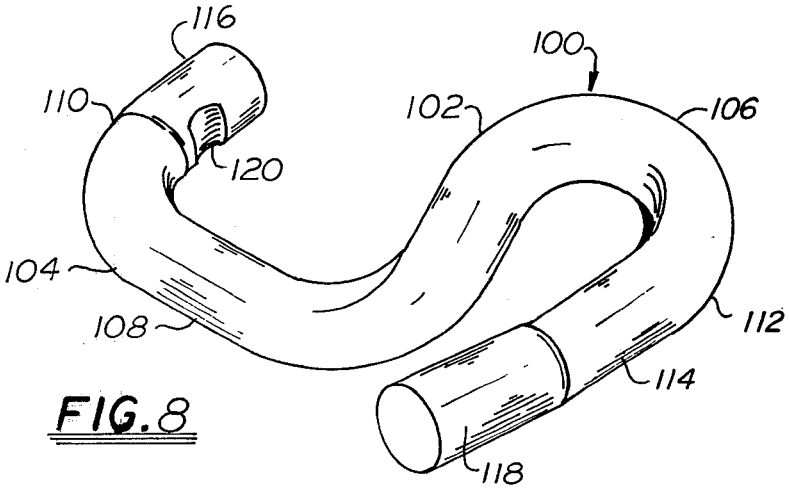
FIG. 8 is an isometric view of a torsional spring rail clip employed in the rail fastening assembly of the present invention.
Figure 10:
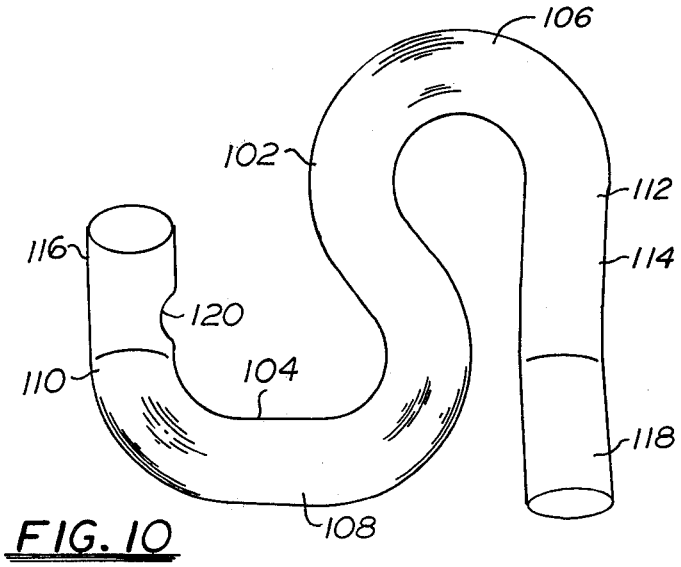
FIG. 10 is a top plan view of the rail clip of FIG. 8.

The rail clip 100, in the preferred embodiment illustrated in FIGS. 8–10, has a somewhat distended S-shaped geometry; being composed of a central leg 102 having a sigmoidal shape and a generally U-shaped tie anchor loop. This distended S-shape is preferred to allow the tie anchor loop to be projected over the mating post of the chair 200, as described below, and permit rotation of the clip for anchoring the rail 12.

The dimensioning and cross-sectional configurations of the elements comprising rail clip 100 may vary widely without departing from the spirit of the present invention; provided the overall S-shaped geometry is maintained. For example, considering each of the tie anchor and rail bearing terminal legs to have a central axis, and the central leg to have an axis of symmetry, the axes of these members might lie on a common plane or on different planes. In another variation, the central axes of the linear legs may be skewed with respect to one another. Similarly, the linear distances separating the tie anchor portion and the rail bearing portion from the central leg may be varied within the limits necessary to maintain the S-shape of the clip. For example, the terminal legs of the clip may be spaced from the central leg by unequal distances.

The foregoing variants in geometrical orientations and configurations permit a considerable range of versatility for the S-shaped clip 100; provided overall S shape is maintained. For example, holding power may be varied as can adaptability for different rail flanges by appropriately altering the geometric angularity and dimensions of the elements.

Figure 6:
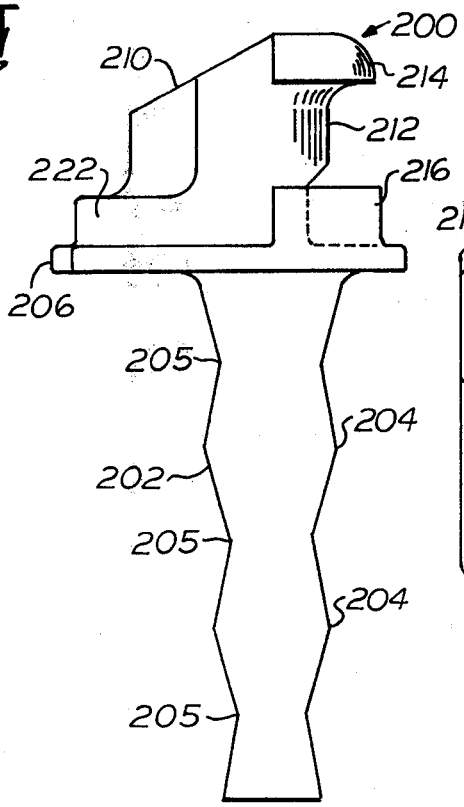
FIG. 6 is a side elevational view of the chair shown in FIG. 5, rotated 90°.
Figure 7:
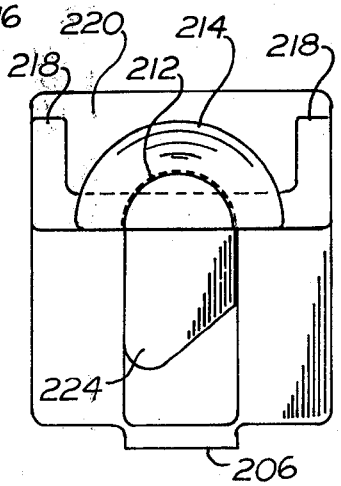
FIG. 7 is a top plan view of the chair shown in FIG. 5.

The chair 200 which cooperates with rail clip 100 is comprised of a downwardly projecting shank 202 adapted to be embedded within concrete tie 14. The cross-sectional profile of the shank or stem 202 is preferably rectilinear, preferably rectangular. The outer surface of the shank 202 is shown in FIG. 6 as provided with a stepped wedge configuration resulting from a plurality of laterally projecting ridges 204 which define spaced recesses 205. Accordingly, the shank or stem 202 as shown in said embodiment has a somewhat undulating geometry which materially improves pull-out resistance of the chair 200 from concrete tie 14.

The shank 202 projects downwardly from a shelf 206. Projecting upwardly from the shelf 206 is a head 210.

Figure 2:
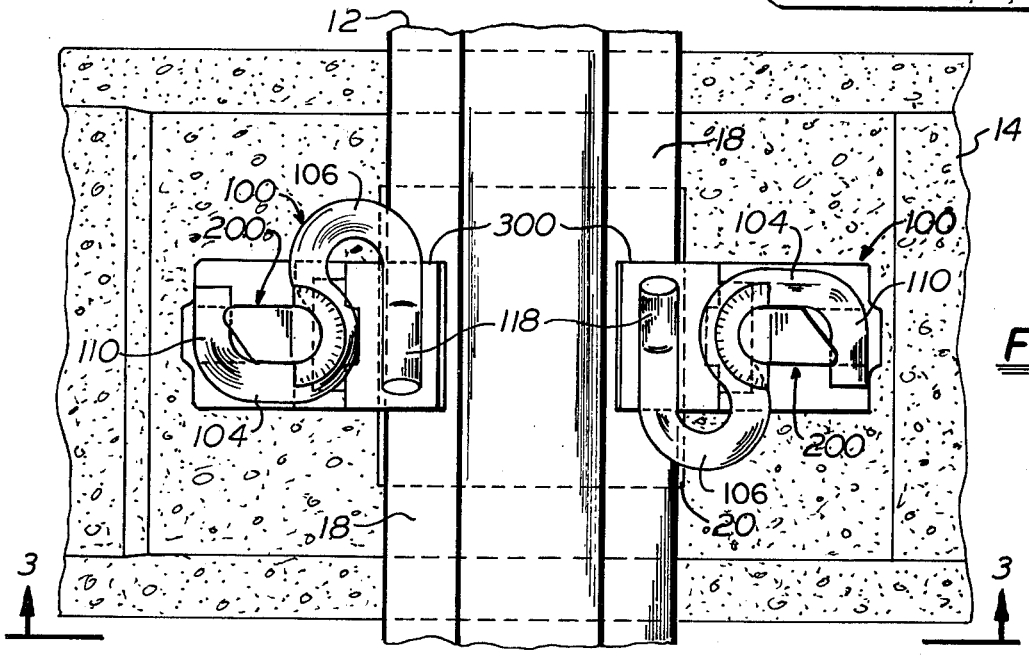
FIG. 2 is a top plan view of the assemblies of FIG. 1.
Figure 5:
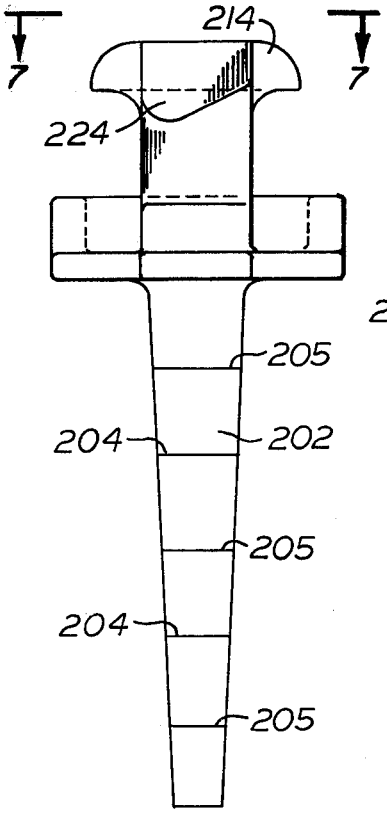
FIG. 5 is a side elevational view of a chair employed in the rail fastening assembly of the present invention.

Head 210 is adapted to receive the tie anchor portion 104 of the rail clip 100 in latching engagement therewith. The head 210 is formed with a jaw 212 on the inner side thereof; the bight of jaw 212 being provided at its upper end with a projecting lip 214 and its lower end with a ledge 216 on shelf 206. Preferably, the ledge 216 is comprised of a pair of spaced ledge members 218 defining an internal pocket 220 therebetween for receiving a portion of pad 300, as described more fully hereinbelow. The bight of jaw 212 is dimensioned to receive the central leg 102 of rail clip 100 in close engagement, as shown in FIG. 2, and the same are complementary in this regard. To provide enhanced cooperation between the clip and the chair, the lip 214 and ledge 216 project laterally beyond the jaw 212, as best viewed in FIG. 5.

A ramp ledge 222 is formed on shelf 206 on the outer side of head 210. The ramp ledge 222 is dimensioned to provide an upward lifting force on the tie anchor terminal leg 110 as the same is twisted into seating engagement with the chair. The ramp ledge 222 can simply consist of a generally horizontal flattened ledge, or could also include an upwardly sloped ramp face at the leading edge thereof. In the embodiment shown, a protuberance 224 is dimensioned to mate with recess 120 formed in the terminal leg 110 of clip 100; such that the members 224 and 120 provide latching engagement between the chair and clip during use. In other words, the protuberance 224 functions as a detent which snaps into recess 120 when the clip 100 is twisted onto head 210. The protuberance 224 could, if desired, be provided on the head 210 in another location; or the latch could consist of a protuberance in the leg 110 with a mating recess in the chair structure itself.

As noted above, the internal pocket 220 is formed on the inner side of head 210, and is dimensioned for receiving a projecting central portion of the shim or insulator pad 300. Pocket 220 insures accurate placement and alignment of insulator pad 300, while preventing any displacement thereof during dynamic operating conditions which occur as a train passes over the railway tracks. The internal configuration of the pocket 220 and the complementary formation of the pad thus improves the structural integrity of the overall assembly and provides a more efficient cooperation of the elements comprising the same.

The shim or insulator pad 300 preferably is interposed between the top, upwardly sloped face of flange 18 and the rail bearing portion 106 of clip 100. A principal purpose of such a pad 300 is for the electrical insulation of the railway rail from those parts securing it to tie 14. The pad must also aid in transmitting an upwardly directed force on terminal leg 114 of clip 100, as described below. Depending upon design requirements for the rail fastening assembly 10, the pad 300 may accomplish either or both of these objectives (i.e., shimming and/or electrical insulation).

Pad 300 is preferably comprised of a coated metallic shim 302 having a layer of encapsulating, insulation-effective polymer 304 coated thereon in order to afford both a force transmitting structure and one which advantageously electrically insulates the rail and fastening assembly. Pad 300 is susceptible, however, to modification if either feature is not desirable; for example, the polymer coating might be eliminated should electrical isolation of the parts be unnecessary. A highly preferred insulator coating is high density polyethylene; although other similar polymeric or other materials capable of withstanding the forces to which the insulator pad will be subjected might be selected by the skilled artisan.

The metal shim 302 is comprised of an outwardly projecting center portion 306, which includes an upstanding leg 308 and a lower leg 310 substantially perpendicular thereto. A leg 312 is formed as a continuous extension of the leg 310, and joins an upstanding leg 314 substantially parallel with leg 308. Accordingly, the legs 308, 310, 312 and 314 define a somewhat rectangular channel 316 extending transversely across metal shim 302,the channel having a pair of recesses 318 formed at the bottom corners thereof. A leg 320 extends obliquely from leg 314; the upper longitudinal and transverse edges thereof having a taper 322 and 324, respectively.

Metal shim 302 is preferably encapsulated by the insulation-effective, high density polyethylene material. As shown, the polyethylene coat the edges of legs 312 and 314 to provide an outwardly directed skirt 326 adjacent the tab 306. The tab 306 may thus be inserted within pocket 220 up to the skirt 326. Channel 316 as shown is filled with polyethylene insulator flush with the top surface of leg 308 for the portion of the channel corresponding to leg 310. Beyond that point, denoted 328, the polyethylene surface slopes upwardly corresponding to the upward slope of leg 320. The outer face of leg 314 as well as the bottom face of leg 320 are also provided with a layer of polyethylene 330 which overlaps the top face of leg 320 in the form of a transverse bulbous element 332. Accordingly, the area of contact between the base flange 18 of rail 12 and the rail fastening assembly 10 is effectively electrically insulated, while forces necessary to restrain the rail 12 may nonetheless be effectively transmitted therebetween.

From the foregoing, it is evident that the rail fastening assembly 10 of the present invention enjoys numerous advantages over rail fastening devices known in the prior art. One particularly advantageous feature is the ease with which the respective components may be fabricated.

Fabrication of the S-clip of the present invention is materially simplified over the clips heretofore proposed. For example, standard bar stock of appropriate length and cross-section to form a single clip can be heated and bent around a mandrel in order to achieve the overall S configuration. Subsequently, the detent and required specific angularity between central axes can be impaired to the preformed clip by way of a forging or similar operation. Uniformity of cross-sectional dimensions permits the attainment of uniform metallurgical properties throughout the clip.

Preferably, a mechanical feeder for round stock introduces a piece of steel bar at about 1800° F. to a two-stage forming press. The steel, preferably, AISI 1060-1095, is preheated and sized in order that the length of the bar is suitable for yielding a single S-clip. The bar stock is fed to the first stage of the press which imparts the overall S-shape thereto by longitudinally bending the stock about appropriately dimensioned mandrels. Thence, the S-shaped bar is rotated 90° and transferred to the second, final forming stage, where the sides and top geometries are imparted to the clip by a transverse bending operation. Lastly, the formed clip is ejected to a quenching bath and tempered as may be desirable. Because of the uniformity of cross-section, homogeneous metallurgical properties are obtained in the finished clip.

The same may be said with respect to the chair 200, which is preferably cast from malleable cast iron. The lack of through bores or other complex re-entrant design reduces the complexity of the casting process by eliminating cores which must be employed in the casting of known chair designs.

Figure 3:
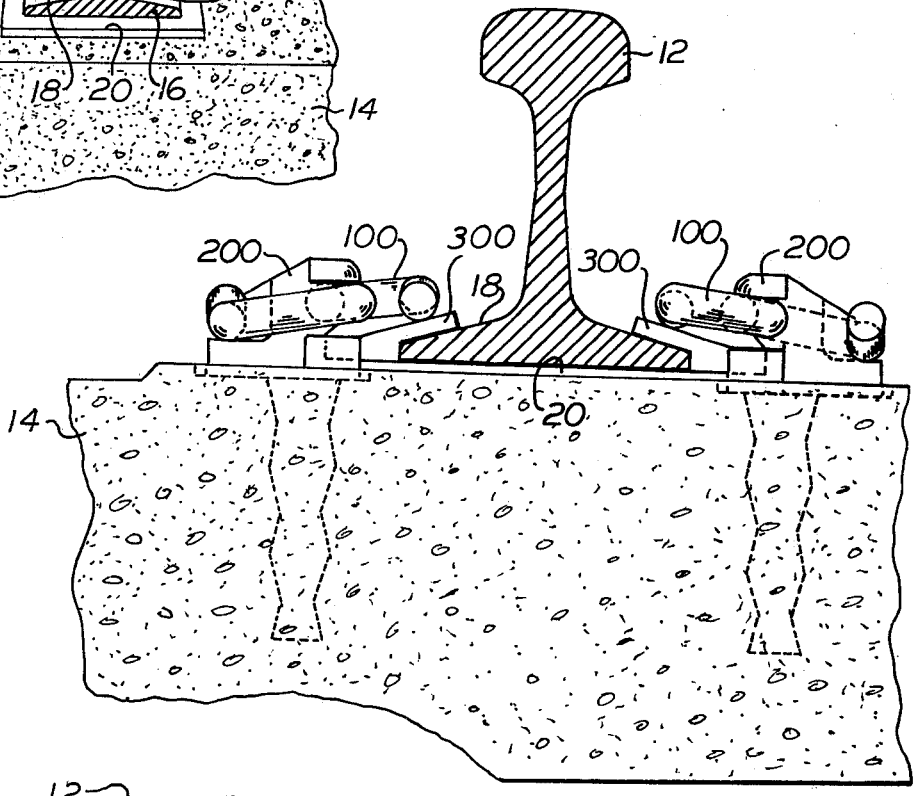
FIG. 3 is an end elevational view along the line 3—3 of FIG. 2.
Figure 4:
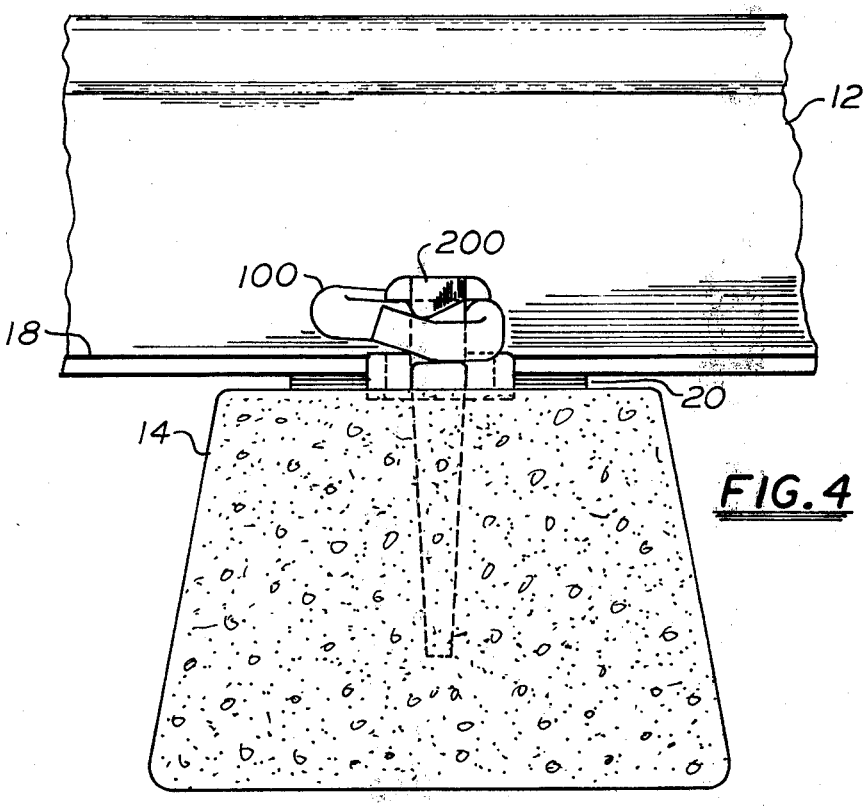
FIG. 4 is a side elevational view of one of the assemblies shown in FIG. 1.

Once the individual components are fabricated, installation thereof is also quite simple. The chairs 200 may be embedded in a concrete tie prior to a full cure thereof, with the plane of shelf 206 substantially level with the top surface of the tie. As shown in FIG. 1–3, a pair of chairs will be positioned adjacent to the area of the tie which receives rail 12. When the tie has been positioned, the tie pad 20 can then be disposed over the tie and rail 12 positioned between the opposing chairs. Shim or insulator pad 300 is then inserted with lip 306 located in pocket 220 of chair 200. The assembly is completed by twisting rail clips 100 into seating engagement with head 210, as illustrated in FIG. 4. Installation of clip 100 on chair 200 is achieved by placing the generally U-shaped tie anchor loop 104 over the head 210 with the rail bearing terminal leg 114 substantially perpendicular to the flange 18 of rail 12. Then, the clip may be rotated into the position shown in FIGS. 1–4. Application of the clips 100 may be manual; although automated apparatus for applying the clips is desirably employed.

As the tie anchor portion 104 is rotated or twisted onto head 210, the terminal leg 110 will engage the ramp ledge 222. Simultaneously, the rail bearing portion 106 of the clip 100 will begin riding upon the upwardly sloped face of the flange 18 of the rail. The movement of terminal legs 110 and 114 across the face of flange 18 and ledge 222 is made smoother due to the somewhat divergent ends of the legs. Consequently, as the clip is rotated, upward forces will be exerted on the two terminal legs 110 and 114. When the clip 100 is fully seated on chair 200, with detent 224 engaging recess 120, the static upwardly directed forces will reach their maximum on these terminal leg members of the clip. The magnitude of these forces can be tailored by appropriate design of the geometrical configuration of the clip structure, taking into account the relative lateral placement of the chair 200 with respect to the rail 12 and the dimensioning of ledge 222. The projecting lip 214 of jaw 212 will provide a counteractive, downwardly directed restraining force on central leg 102, firmly securing the clip against any longitudinal or rotational displacement. Consequently, the upward force exerted on terminal leg 114 by virtue of the sloping face of flange 18 will be resolved as a counterclockwise torsional force at one end of sigmoidal central leg 102; the tensional force being coupled to the central leg by arcuate leg 112. Similarly, the upward force exerted upon terminal leg 110 by ledge 222 will be resolved into a clockwise torsional force on the other end of sigmoidal central leg 102; the tensional force in leg 110 being transmitted by arcuate leg 108. In this manner, both ends of central member 102 are wound up yielding a torsional spring clip.

Due to the manner in which the torsional forces are applied to central leg 102, the rail fastening assembly 10 provides a positive downward restraining force on the flange 18. Any motion of the rail, whether it be longitudinal or transverse (including any wave or rocking motion) will not diminish the efficiency of the rail fastening assembly, and that rail motion will be positively counteracted by the downward force on the base flange. Consequently, the rail is efficiently force coupled to the tie or sleeper.

Moreover, the forces (whether static or dynamic) are efficiently distributed by virtue of the rail fastening assembly 10. This is a very important consideration when concrete ties are employed since any stress concentration between the fastening assembly and the tie contributes to enhanced degradation and/or premature failure of the latter. Conversely, uniform force distribution such as that provided by the present invention materially increases the life expectancy of these concrete ties.

While the invention has now been described with reference to certain preferred embodiments, the skilled artisan will recognize that various substitutions, modifications, changes and omissions may be made without departing from the spirit thereof. Accordingly, it is intended that the scope of the present invention be limited solely by that of the appended claims.

What I claim is:

1. An S-shaped torsional spring railway rail clip, adapted to be rotated onto the upwardly projecting head of a cooperating chair, for securing a railway rail to an anchoring support therefor, said rail clip comprising:

(a) a sigmoidal central leg;

(b) a tie anchor portion comprising a first loop defined by a tie anchor arcuate leg and a tie anchor terminal leg having an upwardly divergent free distal end, said tie anchor portion extending from a first end of said central leg and lying on one side thereof; and, (c) a rail bearing portion comprising a second loop defined by a rail bearing arcuate leg and a rail bearing terminal leg having an upwardly divergent free distal end, said rail bearing portion extending from the second end of said central leg and lying on the opposite side from said tie anchor portion to yield a generally S-shaped geometry;

wherein holding power of the clip is achieved predominantly by torsional force.

2. An assembly comprising the rail clip defined in claim 1 in combination with a chair, positioned adjacent a railway rail, said chair having anchoring means for securing said chair to a support for said rail and head means for engagement with said rail clip, wherein said head means includes jaw means for receiving at least a portion of said central leg, for providing a downward restraining force thereon when said clip is driven onto said chair and for positioning the distal portion of said rail loop on the base flange of said rail, and ramp means for establishing an upwardly directed force on the distal portion of said tie loop when said clip is rotated into engagement with said chair;

wherein, rotating said clip onto said chair causes the establishment of a rail-holding effective torsional force on said central leg.

3. A rotatable rail fastening assembly for securing a railway rail, having laterally projecting base flanges, to an anchoring support therefor, said assembly comprising:

(a) a generally S-shaped torsional spring rail clip including a generally sigmoidal central leg, a tie loop having an arcuate portion extending from a first end of said central leg and a distal portion, and a rail loop having an arcuate portion extending from the second end of said central leg and a distal portion; and, a chair positioned adjacent a railway rail having anchoring means for securing said chair to a support for said rail and head means for engagement with said rail clip, wherein said head means includes jaw means for receiving at least a portion of said central leg, for providing a downward restraining force thereon when said clip is rotated into engagement with said chair and for positioning the distal portion of said rail loop on the base flange of said rail, and ramp ledge means for establishing an upwardly directed force on the distal portion of said tie loop when said clip is rotated into engagement with said chair;

wherein rotating said clip into engagement with said chair causes the establishment of a rail-holding effective torsional force on said central leg.

4. The assembly of claim 2 or 3, wherein said head means projects through the tie loop.

5. The assembly of claim 4, wherein said head means is engaged with both of said central leg and tie loop.

* * * * *